United States Patent [19]

Hayes

[11] 4,247,048

[45] Jan. 27, 1981

[54] DISPENSING NOZZLE

[75] Inventor: Thomas H. Hayes, Baton Rouge, La.

[73] Assignee: Ethyl Corporation, Richmond, Va.

[21] Appl. No.: 24,788

[22] Filed: Mar. 29, 1979

[51] Int. Cl.[3] ..... B05B 1/12

[52] U.S. Cl. ..... 239/396; 239/394; 239/478; 239/579; 239/333; 222/553

[58] Field of Search ..... 239/394, 396, 397, 478, 239/479, 491, 493, 490, 579, 333; 222/553, 554

[56] References Cited

U.S. PATENT DOCUMENTS

| | | | |
|---|---|---|---|
| 3,843,030 | 10/1974 | Micallef | 239/478 |
| 3,967,765 | 7/1976 | Micallef | 239/538 |
| 4,020,982 | 5/1977 | Micallef | 239/538 |
| 4,054,205 | 10/1977 | Blow, Jr. et al. | 222/553 |

FOREIGN PATENT DOCUMENTS

| | | | |
|---|---|---|---|
| 210452 | 9/1957 | Australia | 239/579 |

*Primary Examiner*—Robert Saifer

*Attorney, Agent, or Firm*—Donald L. Johnson; John F. Sieberth; Edgar E. Spielman, Jr.

[57] ABSTRACT

A two-piece nozzle for use on hand actuated pump dispensers is disclosed. The nozzle features a tubular member, which may be a part of the main body of the pump, having a circular, planar face at its terminal end. A hollow bore extending through the tubular member and the hollow face is in liquid passage communication with a recess in the planar face. A cap is rotatably mounted to the tubular member and has an end wall with a planar inside surface which will form an interface with the circular planar face of the tubular member. Radially displaced from the center axis of the circular skirt is a dispensing orifice which is registerable with the recess present in the planar face of the tubular member. A sealing boss surrounds the dispensing orifice and bore to provide a liquid-tight seal with the planar face when the orifice is not in registration with the recess. Mounting structure is provided on the cap and tubular member for achieving a rotating mount of the cap to the tubular member.

8 Claims, 9 Drawing Figures

DISPENSING NOZZLE

BACKGROUND OF THE INVENTION

Aerosol dispensers widely used in the packaging industry present two major problems: atmospheric polution from the propellant and disposal of the cannister without the risk of explosion and the accompanying hazzard to personal safety. The use of hand actuated pump dispensers as a substitute for aerosol dispensers obviates these problems but is not without its own problems. One of the major problems with such pump dispensers is that they have a tendency to leak through the dispensing nozzle in shipping and in use. Claims of non-leaking nozzle structure have been made in the prior art. For example, see U.S. Pat. Nos. 3,685,739 and 3,843,030. Not only is it desirable that the nozzle structure prevent leaks, but it is also desirable that the nozzle be adjustable to provide widely varying discharge patterns. It is, of course, advantageous that the number of separately molded parts making up the nozzle be kept at a minimum and that their design be kept as simple as possible.

It is therefore an object of this invention to provide a new and novel two-piece nozzle having a design which is the paragon of simplicity. Another object of this invention is to provide a nozzle capable of providing varying discharge patterns. In addition to the above, it is an object of this invention to provide a nozzle which is leak-free.

THE INVENTION

The nozzle of this invention features: (A) a tubular member having at its terminal end a circular, planar face which is coaxial with a hollow bore extending through the tubular member and the planar face, and the planar face having at least one recess in liquid passage communication with the bore; (B) a cap having (i) an end wall with a planar inside surface, (ii) a cylindrical, hollow skirt projecting from the inside surface, a dispensing orifice in the end wall eccentric with the center axis of the circular skirt and registerable with the recess in the planar face; (iii) a sealing boss on the inside surface surrounding the dispensing orifice and surrounding the bore when the cap is fitted to the tubular member, the sealing boss forming, throughout its extent, a liquid-tight seal with the planar face, except for that portion of the boss overlying the recess when the orifice is in registration with the recess; and (C) first and second mounting means, carried by the tubular member and cap respectively, for achieving rotatable mounting of the cap to the tubular member.

From the above it can be seen that when the first mounting structure is integral with the tubular member and the second mounting structure is integral with the tubular member, a two-piece nozzle is provided. From the above description and the drawings, the simplicity of structure is evident. Not only is the structure simple in design but it is also highly suitable for injection molding techniques when the nozzle is of thermoplastic materials. In the embodiment described above, the nozzle is a two position nozzle, i.e., a first position for dispensing of the liquid and a second position for closing off dispensing. In the closed position the sealing boss seals against the planar face so that no leakage through the orifice occurs as the orifice is isolated from the bore.

In another embodiment, the nozzle of this invention has the capability to produce varying spray patterns.

This capability is accomplished by providing a particular liquid path that the liquid must follow before it is dispensed through the cap orifice. For example, if a spray pattern is desired a path causing the liquid to swirl prior to leaving the orifice is used. If a stream pattern is desired, a direct path to the orifice is provided. Defining a swirling path is accomplished by using a particularly sized recess in combination with a second boss, the second boss having a specified configuration to give the swirl action.

These and other features of a preferred embodiment of this invention contributing satisfaction in use and economy in manufacture will be more fully understood when taken in conjunction with the accompanying drawings in which identical numerals refer to identical parts and in which.

Figure 1:
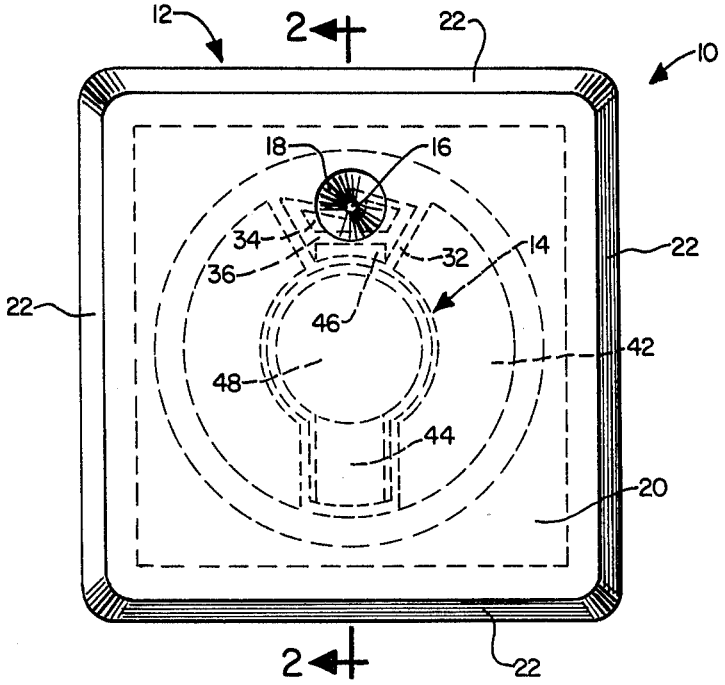
FIG. 1 is a front elevational view of an embodiment of this invention showing the cap in a first dispensing position.

Referring now to the figures, it can be seen that a nozzle of this invention, generally designated by the numeral 10, has a tubular member, generally designated by the numeral 14, and a cap, generally designated by the numeral 12. Preferably both tubular member 14 and cap 12 are made of thermoplastic material. Exemplary of suitable materials are polypropylene, polyethylene, nylon or ABS plastic. It is preferable that the cap and tubular member be of dissimilar materials, with one material being harder than the other. By having one material harder, high fidelity liquid seals are possible as the harder material will "seat" into the softer materials. Exemplary of preferred material combinations are low density polyethylene for the cap and high density polyethylene for the tubular member; and polypropylene for the cap and low density polyethylene for the tubular member. Conventional injection molding may be utilized to form cap 12 and tubular member 14.

Cap 12 has an end wall 20 which is integrally formed with outside skirt 22. End wall 20 is essentially square for the embodiment shown in the drawings, however end wall 20 may be round, triangular or any other shape which the producer of the nozzle of this invention desires. Skirt 22 follows the peripheral shape of end wall 20 but may be of any desirable shape, no criticality being ascribed to the shape of outside skirt 22. End wall 20 has a planar inside surface 21, as shown in FIGS. 2, 4, 5, 8 and 9. Projecting inwardly from planar inside surface 21 is cylindrical hollow skirt 24. Hollow skirt 24 has an inside diameter at its endmost proximate planar inside surface 21 substantially equal to the outside diameter of circular planar face 42, which face is hereinafter described. At the distal end of skirt 24 there is provided inwardly extending, annular protuberance 26. This protuberance co-acts with annular flange 40, which is a part of tubular member 14, to form a shap fit between the cap and tubular member. Other structure may be utilized for achieving a rotatable mount between cap 12 and tubular member 14 without departing from the spirit of the present invention. For example, flange 40 could have a radially extending, annular protuberance which would snap into an annular, hollow groove carried on the inner surface of skirt 24 to achieve the same sort of fit depicted for the embodiment shown in the drawings.

When cap 12 is mounted to tubular member 14, skirt 24 is preferably coaxial with bore 48 of tubular member 14. Radially displaced from the center axis of skirt 24 is orifice 16. A cone shaped depression 18 is made on the outside face of end wall 20 and in communication with orifice 16 to provide a free, non-interferred with, path for liquid as it is dispensed from orifice 16. On planar inside surface 21 there is provided sealing boss 32. Sealing boss 32 is raised from planar inside surface 21 and extends to the intersection between skirt 24 and planar inside surface 21. The thickness, or height, of sealing boss 32 is such that it will be in sealing engagement with planar face 42 of tubular member 14 when orifice 16 is not in registration with a recess in planar face 42 as hereinafter described. Sealing boss 32 surrounds both orifice 16 and bore 48. For the embodiment shown in the drawings boss 32 has a key-hold shape so that it will surround the orifice, bore and the recess which is not in registration with the orifice when the other recess is in registration.

Figure 5:
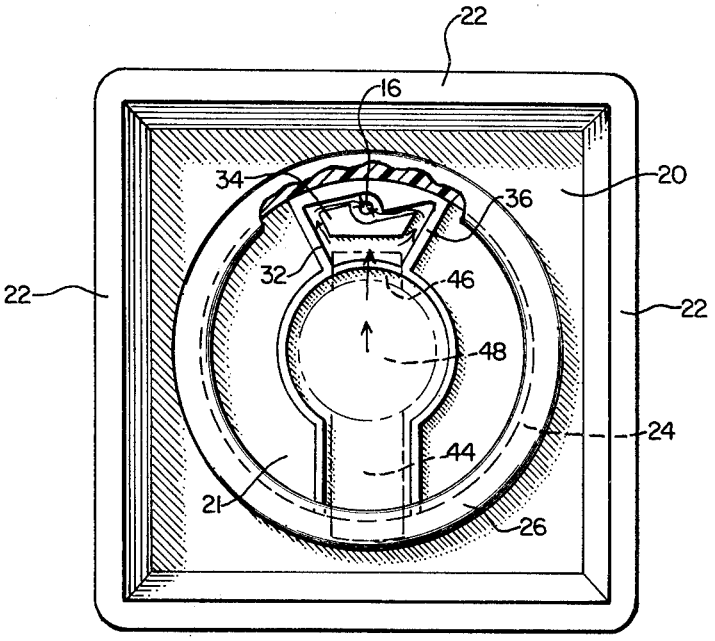
FIG. 5 is a partially broken, rear elevational view of the cap shown in FIG. 1 in the position shown in FIG. 1.
Figure 8:
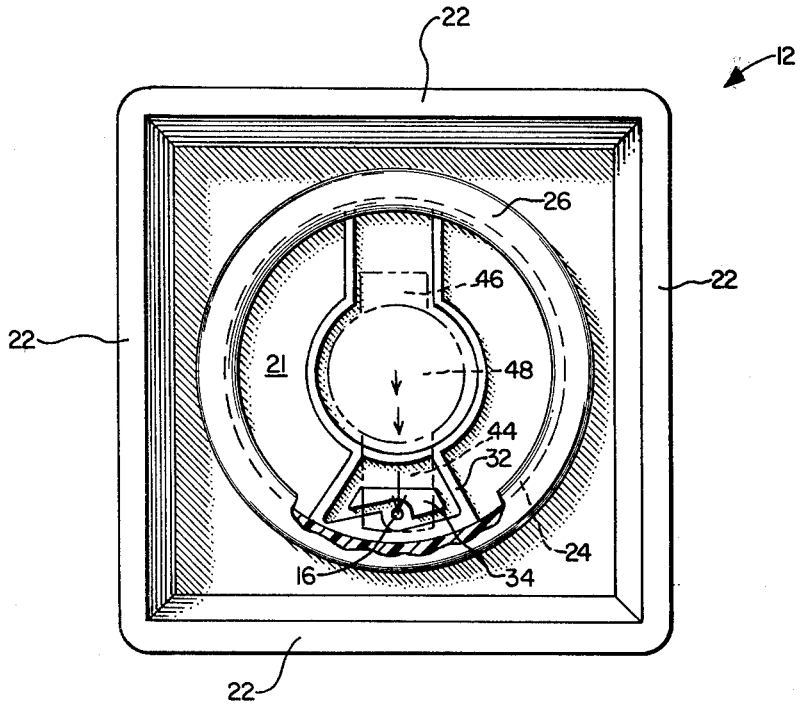
FIG. 8 is a partially broken, rear elevational view of the cap shown in FIG. 1 in the position depicted in FIG. 3.
Figure 9:
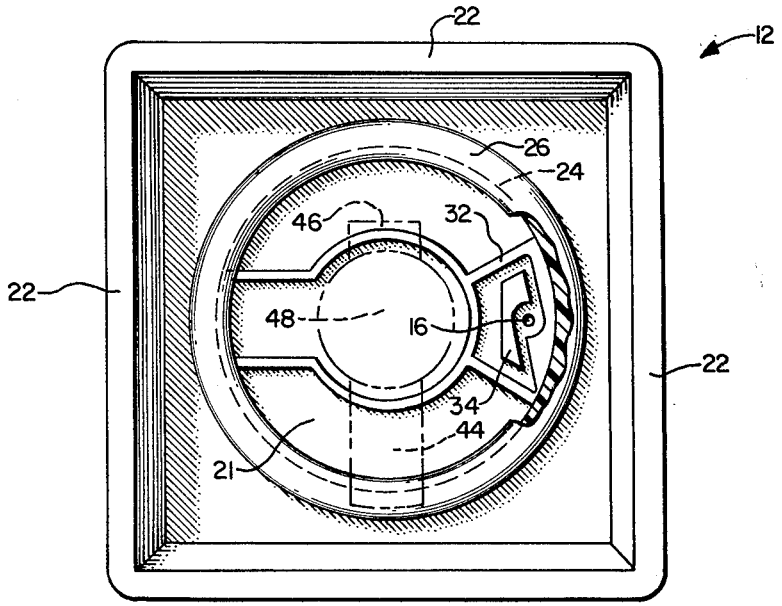
FIG. 9 is a partially broken, rear elevational view of the cap shown in FIG. 1 in the shut-off position.

Within the boundaries defined by sealing boss 32 there is provided a second boss 34. As can be seen in FIGS. 5, 8 and 9, these bosses, in combination, define a passageway 36 which leads to orifice 16. The particular passageway shown in the embodiment depicted in the drawings will provide a swirl chamber when liquid is restricted to passageway 36, as depicted in FIGS. 5, 8 and 9. When the liquid is required to follow passageway 36 before it is allowed to leave through orifice 16 a spray dispensing mode is achieved. The particular design of second boss 34 can be altered to provide different types of swirl chambers which are well known in the art to achieve the same spray pattern.

When it is not desired to provide a spray dispensing mode, second boss 34 may be left out. In this instance the dispensing mode will be streamlike.

Figure 6:
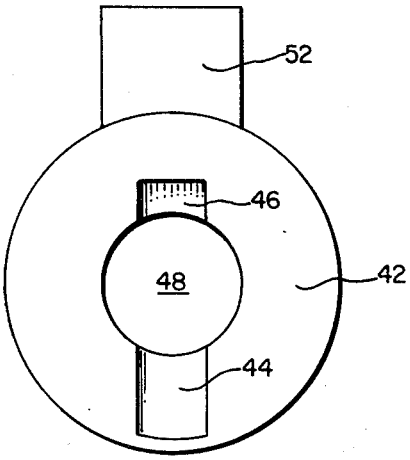
FIG. 6 is a front elevational view of the tubular member shown in FIG. 2.
Figure 7:
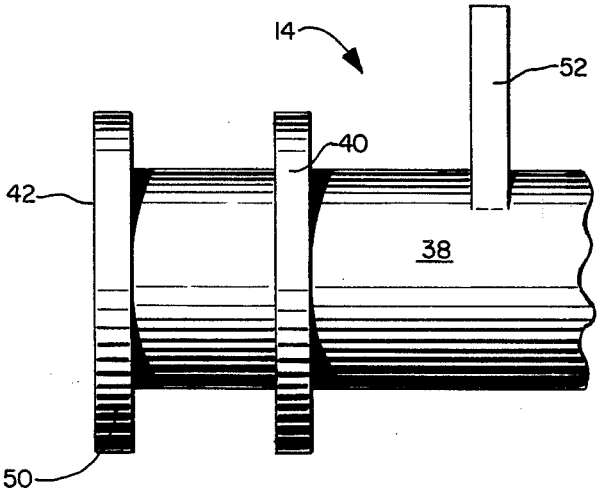
FIG. 7 is a side elevational view of the tubular member shown in FIG. 6.

Tubular member 14 has at its terminal end a circular planar face 42, hereinabove mentioned. Planar face 42 has an outside diameter substantially equal to the inside diameter of skirt 24. In the embodiment shown, it can be seen, in FIGS. 6 and 7, that planar face 42 is a face of an annular flange 50. Within the barrel portion 38 of tubular member 14 there is bore 48. Bore 48 is in liquid communication with the pumping mechanism which is downstream of barrel 38 and is not shown. The pumping mechanism may be any conventional, hand-operated pump using, for example, a piston or bladder to achieve movement of the liquid. Barrel 38 has also integrally formed thereto annular flange 40 which co-operates with protuberance 26 to achieve a snap fit therewith so that cap 12 can be rotatably mounted to tubular member 14. Standing post 52 is for appearance sake only and has a height so that it is substantially in line with outer skirt 22 of cap 12.

On planar face 42 there is provided, in the embodiment shown in the drawings, two recesses—recess 46 and recess 44. Recess 46 is of less radial extent than recess 44. When recesses 46 and 44 are utilized it is possible, with cap 12, to provide two modes of dispensing. Naturally, if only one mode of dispensing is necessary then one of the recesses may be left out. All recesses will be in liquid communication with bore 48.

Figure 2:
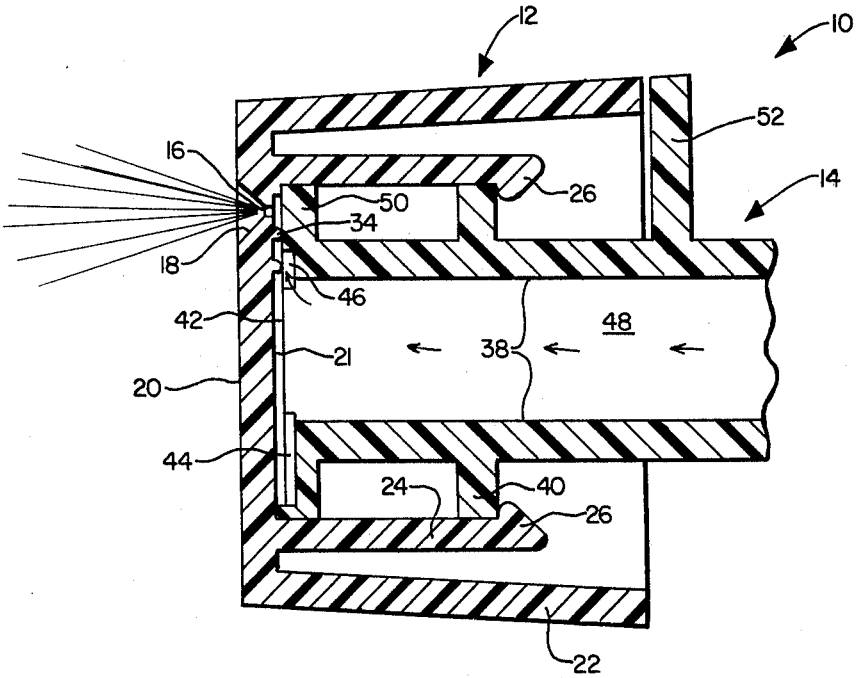
FIG. 2 is a sectional view taken through section lines 2—2 in FIG. 1.

The different modes of dispensing are shown in FIGS. 1–5 and 8–9. To achieve a spray pattern, cap 12 should be rotated so that orifice 16 is in registration with recess 46 as is shown in FIGS. 1, 2 and 5. In this position liquid enters the nozzle through bore 48 and fills the interface between planar inside surface 21 and planar face 42 which is bounded by the extent of boss 32. Liquid also fills recess 46 and thus attains entry into passageway 36. This is possible since sealing boss 32 is not able to make a liquid-tight seal over recess 46 as it does not make sealing contact with the bottom of the recess. However, a liquid-tight seal is maintained where sealing boss 32 is still in contact with planar face 42. Second boss 34 makes sealing contact with planar face 42 as recess 46 does not extend under this recess. As the liquid enters passageway 36 it is forced to follow the path prescribed by second boss 34 and sealing boss 32 and then exit orifice 16. Since the bosses, in the drawings, prescribe a swirl chamber, the liquid will leave orifice 16 as a spray.

Rotation of cap 12 90° away from the position depicted in FIGS. 1, 2 and 5 will result in the nozzle being shut off. This position is shown in FIG. 9. As can be appreciated, sealing boss 32 is tightly seated against planar face 42 and liquid is unable to attain access to orifice 16.

Figure 3:
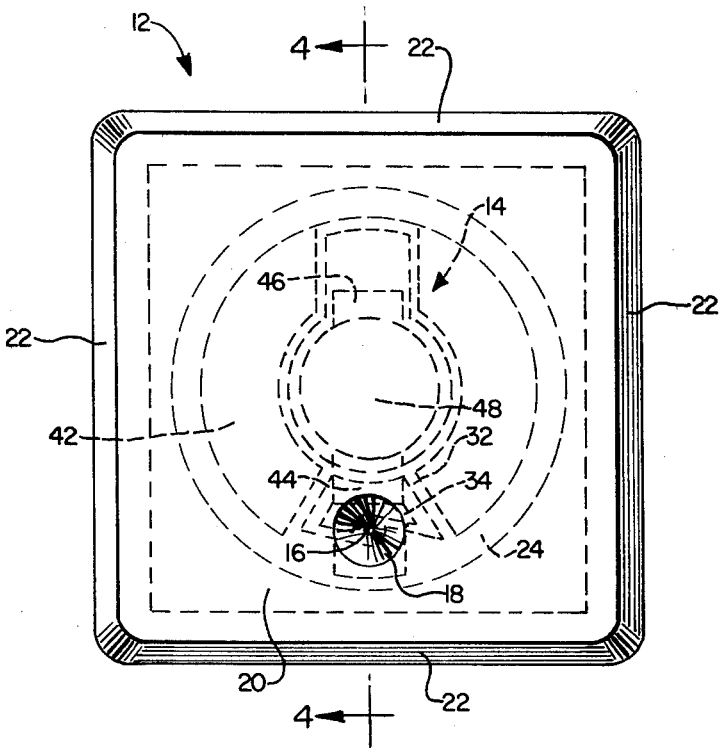
FIG. 3 is a front elevational view of the embodiment shown in FIG. 1 with the cap in a second dispensing position.
Figure 4:
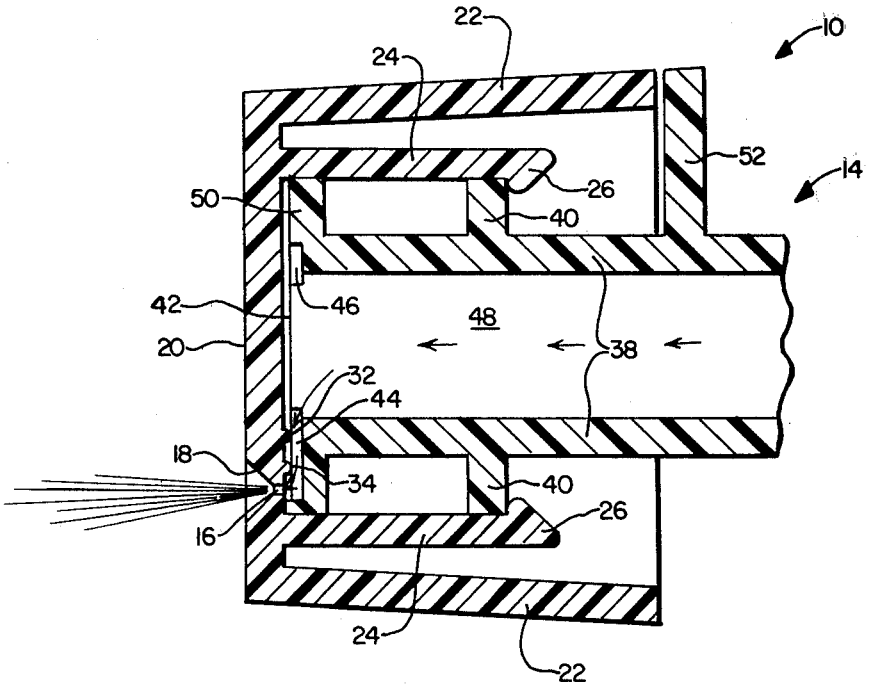
FIG. 4 is a sectional view taken through section lines 4—4 in FIG. 3.

Rotation of cap 12 another 90° will register orifice 16 with recess 44. In this position liquid is allowed access to orifice 16 as once again sealing boss 32 is not able to achieve a liquid-tight seal due to its overlying recess 44. Liquid reaches orifice 16 by a direct route since recess 44 extends radially outwardly a distance sufficient to negate the requirement that the liquid follow path 36 as second boss 34 is unable to achieve a seal throughout its extent with planar face 42. Since the liquid is not actually following any prescribed path it will take the path of least resistance and discharge from orifice 16 as a stream. This mode of dispensing is depicted in FIGS. 3, 4 and 8.

As can be appreciated from the foregoing, the two-piece nozzle of this invention will enable the manufacturer to select whether or not he wishes that his nozzle have a single spray pattern or multiple spray patterns. In any case, the nozzle manufacturer can be assured that his nozzle will be able to provide a liquid-tight seal so that leakage does not occur through the orifice or at the point of connection between the cap and the tubular member.

What is claimed is:

1. A nozzle for the dispensing of liquids, said nozzle comprising:

a. a tubular member having at its terminal end a circular, planar face, said planar face being coaxial with a hollow bore extending through said tubular member and said planar face, and said planar face having at least one recess in liquid passage communication with said bore;

b. a cap having i. an end wall with a planar inside surface, ii. a cylindrical, hollow skirt projecting from said inside surface, a dispensing orifice in said end wall eccentric with the center axis of said circular skirt and registerable with said recess in said planar face;

iii. a sealing boss on said inside surface surrounding said dispensing orifice and surrounding said bore when said cap is fitted to said tubular member, said sealing boss forming, throughout its extent, a liquid-tight seal with said planar face, except for that portion of said boss overlying said recess when said orifice is in registration with said recess; and c. first and second mounting means, carried by said tubular member and said cap respectively, for achieving rotatable mounting of said cap to said tubular member.

2. The nozzle of claim 1 wherein said first mounting means is an annular flange integral and coaxial with said tubular member and said second mounting means is a cylindrical, hollow skirt projecting from said inside surface and having an inwardly extending protuberance integral with and about the inside diameter of said skirt, said protuberance forming a snap fit with said flange.

3. The nozzle of claim 1 wherein said planar face additionally has a second recess angularly displaced from said first mentioned recess, said second recess being in liquid passage communication with said bore and said second recess having a radial extent greater than the radial extent of said first recess and wherein, when said orifice is in registration with one of said recesses, said sealing boss forms a liquid-tight seal that surrounds the other recess.

4. The nozzle of claim 3 wherein said recesses are displaced 180° apart.

5. The nozzle of claim 3 wherein said cap has a second boss associated with said orifice and surrounded by said sealing boss, said second boss having a configuration to produce a first dispensing mode when said orifice is in registration with said first recess and a second dispensing mode when said orifice is in registration with said second recess.

6. The nozzle of claim 5 wherein said first mode is a spray and said second mode is a stream.

7. The nozzle of claim 5 wherein said recesses are displaced 180° apart.

8. The nozzle of claim 7 wherein said configuration provides a swirl chamber upon registration of said sealing boss with said first recess.

9. The nozzle of claim 1 wherein said nozzle is of a thermoplastic material.

10. The nozzle of claim 1 wherein said cap has a second boss surrounded by said sealing boss, said second boss having a configuration to produce a spray upon dispensing said liquids through said orifice.

11. The nozzle of claim 10 wherein said configuration provides a swirl chamber upon registration of said sealing boss with said first recess.

* * * * *